United States Patent [19]

Omote

[11] 4,106,640

[45] Aug. 15, 1978

[54] LOADING APPARATUS FOR CARGO VESSEL

[75] Inventor: Sadao Omote, Tokyo, Japan

[73] Assignee: Nissei Shipping Co., Ltd., Tokyo, Japan

[21] Appl. No.: 771,373

[22] Filed: Feb. 23, 1977

[30] Foreign Application Priority Data

Mar. 9, 1976 [JP] Japan ..... 51-25288

[51] Int. Cl.[2] ..... B63B 27/22

[52] U.S. Cl. ..... 214/14; 198/594; 198/607; 198/631; 214/15 D

[58] Field of Search ..... 214/12, 14, 15 D, 15 E; 198/586, 594, 607, 631, 812; 114/72

[56] References Cited

U.S. PATENT DOCUMENTS 3,520,396 7/1970 Lingg ..... 214/14 X

FOREIGN PATENT DOCUMENTS 2,253,441 11/1972 Fed. Rep. of Germany ..... 114/72

*Primary Examiner*—Drayton E. Hoffman
*Assistant Examiner*—George F. Abraham

[57] ABSTRACT

A loading apparatus for a cargo vessel comprising conveyor means including a loading-in conveyor, a first turning conveyor, a traversing conveyor, a second turning conveyor and a lowering conveyor; and conveyor switching means to move said first and second turning and traversing conveyors transversely of said vessel either to a first position in which one of said first and second turning conveyors projects from one of the sides of said vessel over a quay, or to a second position in which the other turning conveyor projects from the other side of said vessel over the quay. In the first position of the movable conveyors, the loading-in conveyor is arranged between the one turning conveyor and the quay in an inclined manner while the lowering conveyor is arranged between the other turning conveyor and the bottom of the uppermost hold of said vessel in an inclined manner. In the second position of the movable conveyors, the loading-in conveyor is arranged between the other turning conveyor and the quay in an inclined manner while the lowering conveyor is arranged between the one turning conveyor and the bottom of the uppermost hold of said vessel.

6 Claims, 8 Drawing Figures

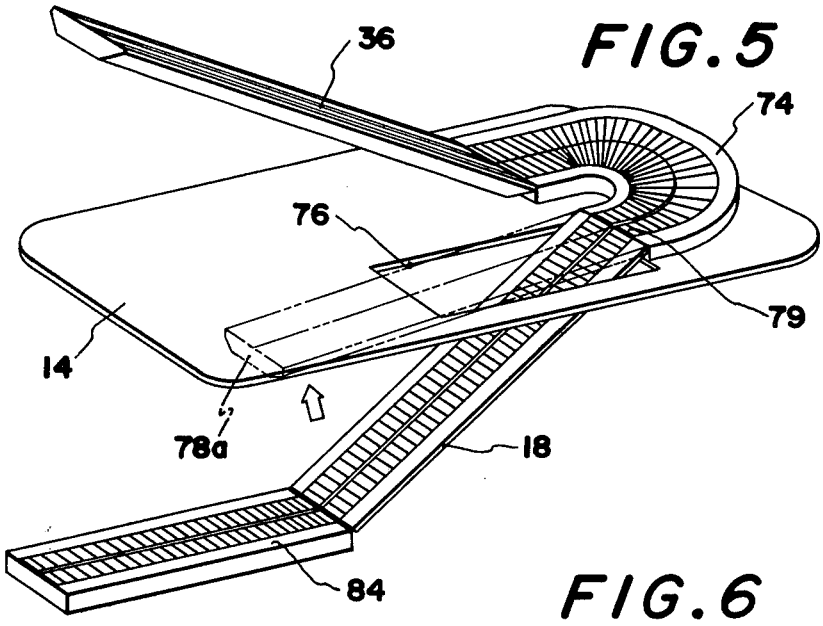
FIG. 5
FIG. 6
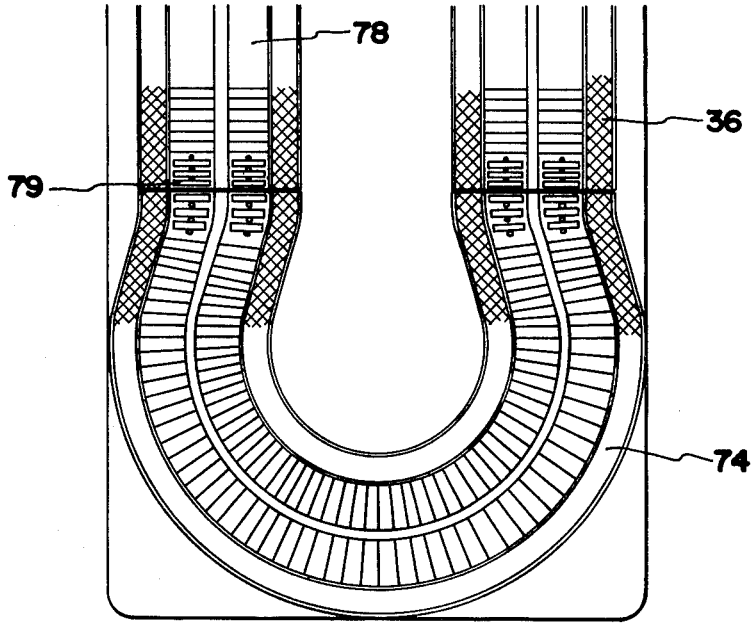

LOADING APPARATUS FOR CARGO VESSEL

BACKGROUND OF THE INVENTION

Conventionally, various cargoes have been loaded or unloaded by means of various loading means, such as cranes, winches or assembling conveyor means. Suspension type loading means, such as cranes or winches must however be installed on the deck of the vessel and this causes the equipment on the deck to be complicated and, therefore, causes the operation to be troublesome. Loading and unloading the cargoes by use of the assembling conveyor means is ineffective in operation. In addition, the conveyor means, such as roller type or belt type conveyor cannot convey cars which can automatically move. Thus, in case both general cargoes and cars are required to be loaded or unloaded, only conveyor means cannot be used.

In general, each of the multi-storied holds in the vessel is partitioned into a plural of chambers or subholds by partition walls which are required to be uniformly spaced in a limited manner in view of physical strength of the vessel. Thus, the conveyors which are used to transfer the cargoes from the upper to the lower hold of the adjacent holds, are limited in their lengths. This causes the difficulty of the inlet or upper end of the lower conveyor to be connected directly to the outlet end of the upper conveyor, which causes the loading operation to be ineffective.

SUMMARY OF THE INVENTION

Accordingly, it is a principal object of the present invention to provide a loading apparatus for a cargo vessel adapted to be always installed in the vessel and to load and unload various cargoes in an effective manner.

It is another object of the present invention to provide a loading apparatus for a cargo vessel adapted to load or unload not only general cargoes but also cars by means of conveyor type loading means.

It is further object of the present invention to provide a loading apparatus for a cargo vessel adapted to continuously transfer cargoes from the upper to the lower hold of the adjacent holds in the vessel in a more effective manner.

In accordance with the present invention, there is provided a loading apparatus for a cargo vessel, comprising conveyors means including a loading-in conveyor to load cargoes in the vessel, a first turning conveyor connected to an upper end of said loading-in conveyor to turn said cargoes in a direction traverse to said vessel, a traversing conveyor connected to said first turning conveyor to onvey said cargoes transversely of the vessel, a second turning conveyor connected to said traversing conveyor to turn said cargoes in a direction longitudinal of the vessel, and a lowering conveyor connected to said second turning conveyor to convey said cargoes through a hatch in the uppermost deck to the bottom of an uppermost hold in said vessel through a hatch; and conveyor switching means to move said first and second turning and traversing conveyors transversely of said vessel between a first position in which one of said first and second turning conveyors projects from one of the sides of said vessel over a quay and a second position in which the other turning conveyor projects from the other side of said vessel over the quay, said loading-in and lowering conveyors being detachably mounted so that in said first position, said loading-in conveyor is connected between the one turning conveyor and the quay in an inclined manner while the lowering conveyor is connected between the other turning conveyor and the bottom of said uppermost hold in an inclined manner, and in said second position, said loading-in conveyor is connected between the other turning conveyor and the quay in an inclined manner while said lowering conveyor is connected between the one turning conveyor and the bottom of said uppermost hold in an inclined manner.

BRIEF DESCRIPTION OF THE DRAWINGS

The above and other objects and features of the present invention will be apparent from the description of a preferred embodiment taken with reference to the accompanying drawings in which;

FIG. 5 is an enlarged perspective view of a reversing conveyor and the associated lowering conveyors;

FIG. 6 is a top view of the reviewing conveyor of FIG. 5; and

DETAILED DESCRIPTION OF THE PREFERRED EMBODIMENT

Figure 1:
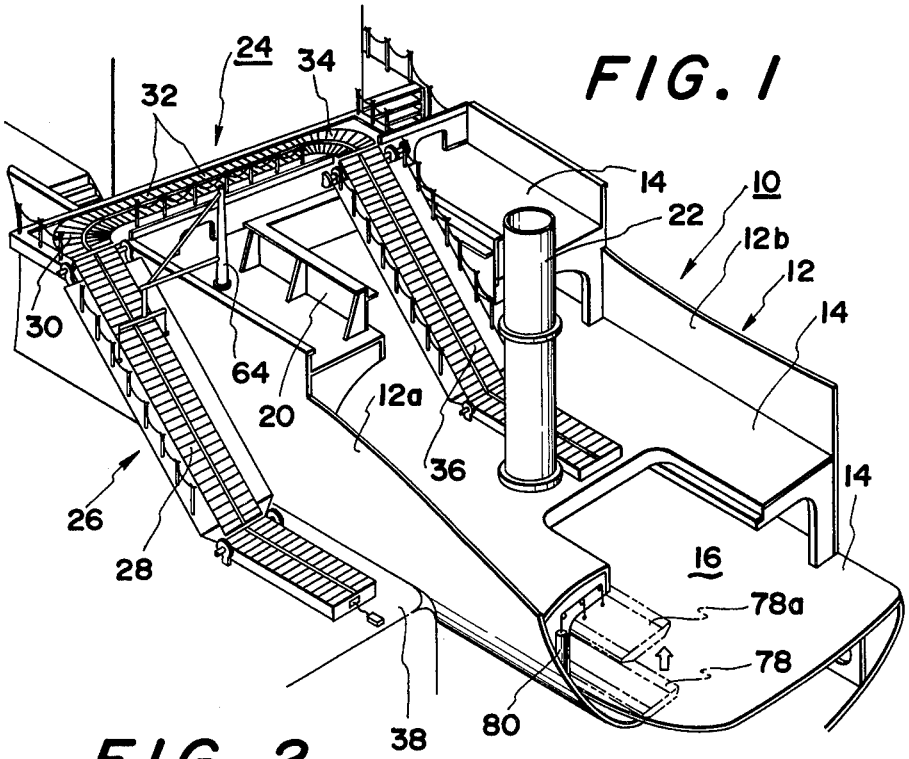
FIG. 1 is a schematically perspective view of a loading apparatus for a cargo vessel in accordance with the present invention.
Figure 4:
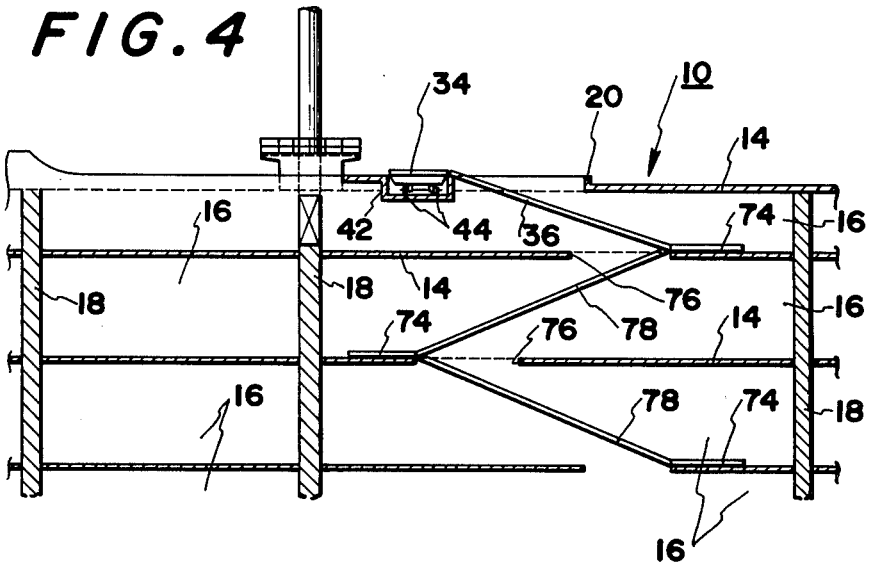
FIG. 4 is a verically and longitudinally cross sectional view of the vessel having the loading apparatus of the present invention.

Referring now to FIG. 1, a cargo vessel 10 comprises a vessel body 12 having left and right sides 12*a* and 12*b*, and a plural of decks 14 defining a plural of holds 16. As shown in FIG. 4, the vessel 10 may preferably have partition walls 18 dividing the holds into a plural of subholds to receive cargoes therein. The partition walls serve to reinforce the vessel 10. A hatch 20 is provided which serves to load or unload cargoes there through. Numeral 22 designates a mast provided vertically and centrally of the vessel 10.

A loading apparatus 24 of the present invention comprises roller type conveyor means 26. As shown in FIG. 1, the conveyor means 26 includes a loading-in conveyor 28 to load the cargoes from a quay 38 into the vessel, a first turning conveyor 30 connected to an outlet or upper end of the loading-in conveyor 28 to turn the loaded-in cargoes in a direction traverse to the vessel, a traversing conveyor 32 connected to the first turning conveyor 30 to convey the cargoes transversely of the vessel, a second turning conveyor 34 connected to the traversing conveyor 32 to turn the cargoes in a direction longitudinal of the vessel, and a main or first lowering conveyor 36 connected to the second turning conveyor 34 to convey the cargoes from the turning conveyor 34 through the hatch in the uppermost deck 14 to the underside deck 14, so that the cargoes are received into the uppermost hold 16. It is shown in FIG. 1 that the loading-in conveyor 28 is disposed along the left side 12*a* of the vessel 10. It should be noted that the loading-in and lowering conveyors 28 and 36 are detachably connected to the first and second turning conveyors at their adjacent ends, respectively. This is required because the first and second turning conveyors 30 and 34 and the traversing conveyor 32 should move transversely of the vessel 10 between two positions as described later.

Figure 2:
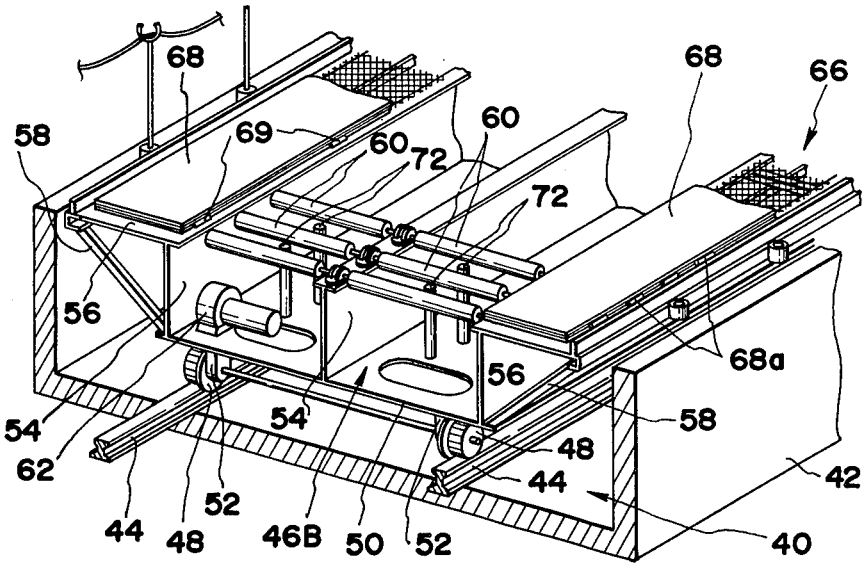
FIG. 2 is an enlarged perspective view of conveyor switching means to move conveyor means between a first position and a second position.
Figure 3:
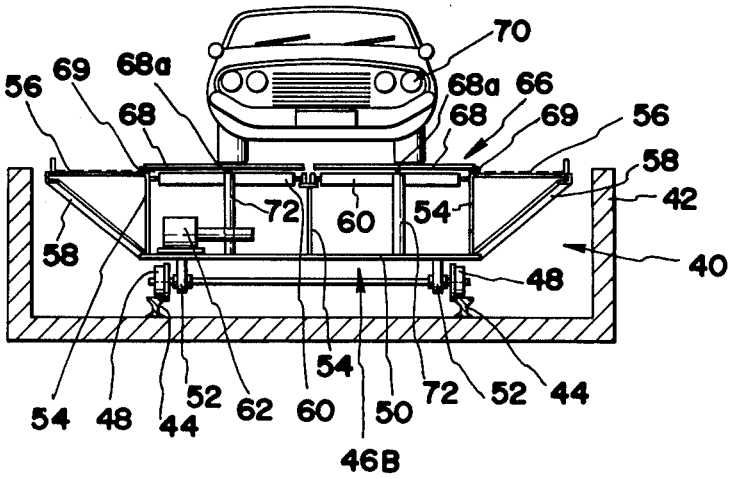
FIG. 3 is a vertically cross sectional view of the conveyor switching means of FIG. 2.
Figure 7:
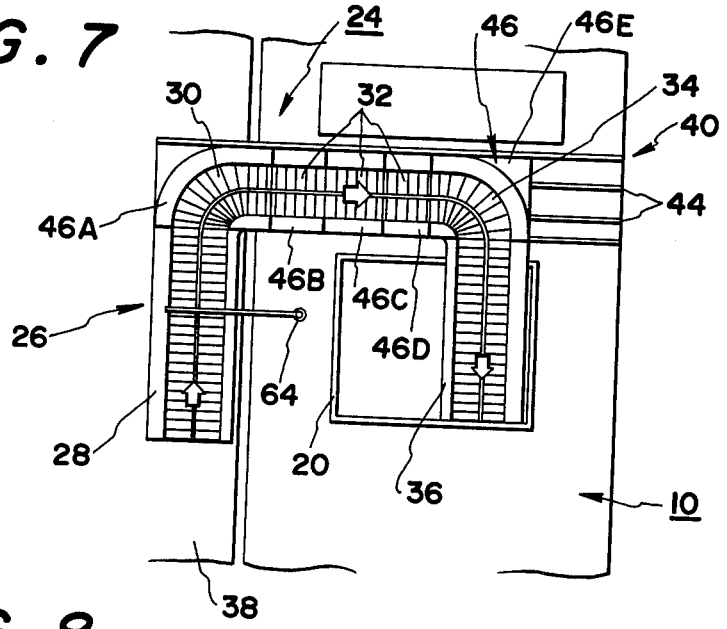
FIGS. 7 and 8 are top views of conveyor means located in a first position and in a second position, respectively.

The loading apparatus 24 also comprises conveyor switching means 40 to move the first and second turning conveyors 30 and 34 and the traversing conveyor 32 transversely of the vessel 10, which is illustrated in FIGS. 2, 3 and 7. The conveyor switching means 40 may comprise a channel type case 42 extending along the direction traverse to the vessel 10. A pair of rails 44 may be provided on the bottom of the case 42 longitudinally thereof. A switching body or carriage 46 includes five carriage sections 46A, 46B, 46C, 46D and 46E, as shown in FIG. 7. One of the carriage sections 46B is shown in FIGS. 2 and 3 and is mounted on and slidably engages the rails 44, with its wheels 48 riding on the rails. The carriage section 46B may comprise a bottom wall 50 on which the wheels 48 may be mounted be respective bearings 52, vertical walls 54 spaced uniformly from each other and secured to the bottom wall 50, and a pair of outside horizontal plates 56 extending from the upper edges of the vertical walls 54 outwardly thereof and secured thereto. Stays 58 may be provided to bear the load applied on the outside horizontal plates 56. Rollers 60 which are supported between the adjacent vertical walls 54, together with those on the carriage sections 46C and 46D constitute the traversing conveyor 32. The rollers 60 may be driven by a motor 62 through a transmission (not shown). The motor 62 may be mounted on the bottom wall 50 of the carriage section 46B.

The other carriage sections 46A, 46C, 46D and 46E are substantially identical in construction to the carriage section 46B, except that the rollers on the carriage sectons 46A and 46E are disposed in an arcuate manner. Of course, the rollers on the 46A and 46E constitute the first and second turning conveyors 30 and 34, respectively.

Figure 8:
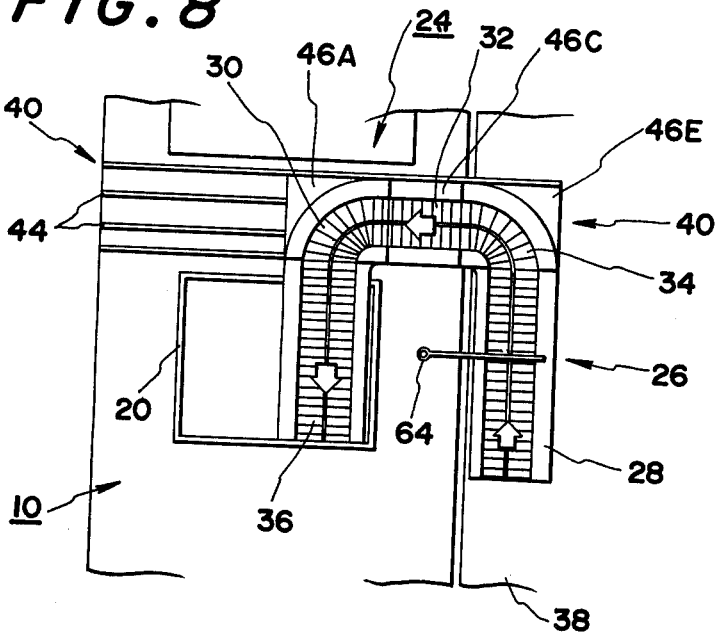

Thus, it will be noted that the first and second turning conveyors 30 and 34 and the traversing conveyor 32 are movable between the first position shown in FIG. 7 and the second position shown in FIG. 8. It will be also noted that the carriage sections 46B, 46C and 46D may be selectively removed together with the corresponding traversing conveyor portions.

As shown in FIGS. 1 and 7, in the first position, the conveyors 30, 32 and 34 are biased in a leftward direction as viewed in FIG. 7 so that the first turning conveyor 30 projects from the side 12*a* of the vessel body 12. Thus, the loading-in conveyor 28 can be connected to the inlet or lateral edge of the first turning conveyor 30, so that the cargoes can be loaded or unloaded through the conveyor meand 26 on the left side 12*a* of the vessel body 12. It will be noted that in the first position, the lowering conveyor 36 connected to the outlet or lateral edge of the second turning conveyor 34 is biased toward the right portion of the hatch 20, so that the lowering conveyor 36 never interfers with the centrally located mast 22.

As shown in FIG. 8, in the second position, the conveyors 30, 32 and 34 are biased in a rightward direction as viewed in FIG. 8 so that the second turning conveyor 34 projects from the side 12*b* of the vessel body 12. Thus, the loading-in conveyors 28 can be now connected to the inlet or lateral edge of the second turning conveyor 34, so that the cargoes can be loaded or unloaded through the conveyor means 26 on the right side 12*b* of the vessel body 12. In order to prevent the lowering conveyor 36 from interference with the mast 22, the traversing conveyor portions on the carriage sections 46B and 46D are removed so that the outlet or lateral edge of the first turning conveyor 30 is just aligned with the lowering conveyor 36 biased against the right edge of the hatch 20.

As shown in FIGS. 7 and 8, a winch 64 may be provided to lift the loading-in conveyor 28 when the loading or unloading operation has been finished.

The conveyor means 26 may also comprise tread plate means 66 which allows cars as the cargoes to be loaded or unloaded while they automatically moves on the tread plate means 66. The tread plate means is illustrated in detail in FIGS. 7 and 8 and comprises a pair of folding plates 68 which are hinged at numeral 69 to the outside horizontal plates 56, resepectively. In case the general cargoes such as packed articles are loaded or unloaded, then the folding plates 68 are folded on the outside horizontal plates 56 as shown in FIG. 2, but in case cars 70 as the cargoes are loaded or unloaded, then the folding plates 68 are expanded on the rollers 60, as shown in FIG. 3, so that they are covered by the plates. Supporting pins 72 may be provided to support the folding plates 68 at the hinges 68*a* when expanded. It should be noted that the supporting pins 72 have the upper ends vertically slightly withdrawn from the upper portions of the rollers 60 so that the general cargoes can be conveyed without any interference with the supporting pins 72. Although not shown, it should be also noted that the tread plate means 66 is provided on the other carriage sections 46A, 46C, 46D and 46E and also on the loading-in and lowering conveyors 28 and 36, so that the cars 70 can be loaded or unloaded through the conveyor means 26.

The conveyor means 26 further comprises a reversing conveyor 74 provided on the bottom of each of the holds 16 adjacent to an opening 76 in the corresponding deck 14. As shown in FIGS. 5 and 6, the reversing conveyor 74 may be in the form of a roller conveyor and is so constructed that the cargoes are turned at an angle of 180°. One end of the reversing conveyor 74 in the uppermost hold 16 is connected to the outlet or lower end of the first lowering conveyor 36 while the other end of the reversing conveyor 74 terminates at the edge of the opening 76 in the corresponding deck. Thus, the cargoes carried in the uppermost hold 16 by the first lowering conveyor 36 are directed to the edge of the opening 76. The other reversing conveyors 74 at one end are connected to a second lowering conveyor which will be described later and at the other end terminate at the edge of the opening 76 in the corresponding decks.

Second lowering conveyors 78 are provided to carry the cargoes from the upperside to the underside one of the holds 16 and may have the inlet or upper end hinged at numeral 79 to the outlet or other end of the upperside inverting conveyor, with the outlet or other end of the second lowering conveyor 78 being seated on the underside deck 14 and connected to the corresponding reversing conveyor 74 at its inlet end. It should be noted that the adjacent ones of the second lowering conveyors 36 and 78 are inclined reversely, as shown in FIGS. 4 and 5. Thus, it will be noted that although the holds 16 are divided into a plural of subholds, the lowering conveyors 78 may be arranged in a moderately inclined manner. It should be noted that the second lowering conveyors may be folded by means of their movement about the hinge 79, as indicated at a broken line 78*a* in FIGS. 1 and 5. The movement of the lowering conveyors 78 may be made by weight 80 which may be operatively associated through a wire 82 with the lower or free ends of the lowering conveyors 78.

Each of the holds 16 may have a leading conveyor 84 which may be detachably connected to the outlet end of the corresponding reversing conveyor 74, so that the cargoes carried into the hold can be transferred to a predetermined area of the hold.

Although the operation of the loading apparatus 24 of the present invention will be apparent from the foregoing description, it will be briefly described hereinbelow. In case the left side 12*a* of the vessel 10 is closely adjacent to the quay 38 as shown in FIG. 1, then the movable conveyors 30, 32 and 34 are moved to the first position in which the loading-in and lowering conveyors 28 and 36 are connected to the turning conveyors 30 and 34, respectively, as shown in FIG. 1. It will be noted that the second lowering conveyors 78 and the reversing conveyors 74 are arranged so that they are continuously connected as shown in FIG. 4. Thus, the cargoes can be continuously carried into the lowermost hold 16 by the conveyor means 26. In the lowermost hold 16, the cargoes may be transferred to the predetermined area by means of the leading conveyor 84. After the lowermost hold has been filled, then the cargoes are subsequently transferred to the upperside holds in the same manner as described in connection with the lowermost hold. Thus, the cargoes may be continuously carried into all the holds. In case the cars may be loaded, then the conveyor means 24, is closed by the tread plate means 66. Thus, the cars can automatically move on the conveyor means 26 to enter the holds in the vessel.

Conversely, in case the right side 12*b* of the vessel 10 is closely adjacent to the quay 38 as shown in FIG. 8, then the movable conveyors 30, 32 and 34 are moved to the second position in which the loading-in and lowering conveyors 28 and 36 are connected to the turning conveyors 34 and 30, respectively, as shown in FIG, 8. Also, the two traversing conveyor portions on the carriage sections 46B and 46D are removed from the traversing conveyor 32 so that the lowering conveyor 36 can be positioned at the same place as described in connection with loading-in of the cargoes on the left side 12*a* of the vessel. The loading-in operation of the cargoes on the right side of the vessel is substantially similar to that on the left side of the vessel.

In wither case, after the loading of the cargoes has been finished in each of the holds, each of the second lowering conveyors 78 is lifted by the weight 80 so that the opening is closed.

While one preferred embodiment has been illustrated and described with reference to the accompanying drawings, it will be understood that they are by way of example, and that various modifications and changes may be made without departing from the spirit and scope of the invention, which is intended to be defined only to the appended claims.

What is claimed is:

1. A loading apparatus for a cargo vessel, comprising conveyor means including a loading-in conveyor to load cargoes in the vessel, a first turning conveyor connected to an inlet end of said loading-in conveyor to turn said cargoes in a direction traverse to sasid vessel, a traversing conveyor connected to said first turning conveyor to convey said cargoes transversely of said vessel, a second turning conveyor connected to said traversing conveyor to turn said cargoes in a direction longitudinal of the vessel, and lowering conveyor connected to said second turning conveyor to convey said cargoes through a hatch in an uppermost deck to the bottom of an uppermost hold in said vessel; and conveyor switching means to move said first and second turning conveyors and said traversing conveyor transversely of said vessel between a first position in which one of said first and second turning conveyors projects from one of the sides of the vessel over a quay and a second position in which the other turning conveyor projects from the other side of the vessel over the quay; said loading-in and lowering conveyors being detachably mounted so that in said first position, said loading-in conveyor is connected between the one turning conveyor and the quay in an inclined manner while the lowering conveyor is connectd between the other turning conveyor and the bottom of said uppermost hold in an inclined manner, and in said second position, said loading-in conveyor is connected between the other turning conveyor and the quay in an inclined manner while said lowering conveyor is connected between the one turning conveyor and the bottom of said uppermost hold in an inclined manner.

2. A loading apparatus as set forth in claim 1, wherein said traversing conveyor includes a plural of traversing conveyor portions which are separately removable, but which form a continuous conveyor surface, said traversing conveyor portions being selectively available.

3. A loading apparatus as set forth in claim 1, wherein said conveyor means further comprises tread plate means which is normally open so that said conveyors are exposed, but which is extendable over said conveyors so that said conveyors are covered closed whereby cars can move thereon to be loaded in the vessel.

4. A loading apparatus as set forth in claim 3, wherein said tread plate means, on each side of each of said conveyors comprises a pair of folding plates hinged to an outside horizontal plate provided outside of each of said conveyors.

5. A loading apparatus as set forth in claim 1, wherein said conveyor means further comprises additional lowering conveyors to convey said cargoes from the upperside to the lowerside one of said decks, the adjacent ones of said additional lowering conveyors being inclined in a reverse manner; and reversing conveyors each provided on the bottom of said respective holds adjacent to an opening to turn said cargoes at an angle of 180°, with an inlet end connected to the outlet end of a preceding additional lowering conveyors and with an outlet end connected to the inlet end of a successive lowering conveyor, whereby said cargoes are continuously lowered into the lowermost hold through the intermediate holds.

6. A loading apparatus as set forth in claim 6, wherein said additional lowering conveyors at their upper end are hinged to the outlet edge of the corresponding reversing conveyors whereby the lower end of each of said additional lowering conveyors is adapted to be lifted until it reaches the deck immediately thereabove.

* * * * *